US008590480B1

(12) United States Patent
Morgan

(10) Patent No.: US 8,590,480 B1
(45) Date of Patent: Nov. 26, 2013

(54) CABLE MAINTENANCE APPARATUS

(75) Inventor: Douglas G. Morgan, Bradenton, FL (US)

(73) Assignee: C.S.B. Concepts, LLC, Bradenton, FL (US)

( * ) Notice: Subject to any disclaimer, the term of this patent is extended or adjusted under 35 U.S.C. 154(b) by 488 days.

(21) Appl. No.: 12/784,211

(22) Filed: May 20, 2010

(51) Int. Cl.

| | |
|---|---|
| ***B05C 13/02*** | (2006.01) |
| ***B05C 11/00*** | (2006.01) |
| ***B05C 5/00*** | (2006.01) |
| ***B05C 1/00*** | (2006.01) |
| ***B05B 3/00*** | (2006.01) |

(52) U.S. Cl.
USPC ..... 118/307; 118/325; 118/323; 118/712; 118/208; 118/708

(58) Field of Classification Search
USPC ..... 118/307, 208, 712, 713, 321, DIG. 11, 118/323, 325; 401/208, 219; 184/17; 451/75, 76, 92; 427/116, 117
See application file for complete search history.

(56) References Cited

PUBLICATIONS

Jun Luo et al; Cable Maintenance Robot and its Dynamic Response Moving on the Horizontal Cable, IEEE, 2005.*

* cited by examiner

*Primary Examiner* — Yewebdar Tadesse
(74) *Attorney, Agent, or Firm* — Ronald E. Smith; Jeremy Spier; Smith & Hopen, P.A.

(57) ABSTRACT

A bridge cable maintenance apparatus attaches to a cable and includes two drivetrains. Once attached, the apparatus is remotely directed along the longitudinal extent of the cable by the first drivetrain. The second drivetrain rotates attachments about the cables axis. The attachments include a variety of maintenance devices that are fastened to the end of the apparatus and allow the user to remotely and safely inspect, paint, clean, and repair the cable.

8 Claims, 4 Drawing Sheets

CABLE MAINTENANCE APPARATUS

BACKGROUND OF THE INVENTION

1. Field of the Invention

This invention relates to bridge maintenance. More specifically, it relates to an apparatus that allows a user to remotely paint, clean, and inspect bridge cables.

2. Description of the Prior Art

The United States has roughly 578,000 highway bridges. The average life span of highway bridges is about 70 years and the majority of bridges currently in use were built after 1945. In addition to old age, bridges are particularly susceptible to environmental damage, such as corrosion, cracking, and fatigue, which can affect a bridge's load carrying capacity. Therefore, routine and regularly scheduled maintenance is critical to maintaining the structural integrity of bridges. The potential penalties for ineffective inspection of bridges can be very severe, including the loss of life, the cost to build a new bridge, the loss of business resulting from limited access or detours, the cost resulting from blockage of a major shipping channel, and the environmental damage due to hazardous materials being transported over the bridge at the time of collapse.

Visual inspection and manual repair costs represent a very significant portion of a bridge's maintenance budget. In addition to being expensive, visual inspections and manual repairs are very dangerous. For example, maintenance workers periodically climb and suspend from cable-stayed bridges in order to inspect and repair their cables. Unfortunately, in performing these inspections and repairs, many workers have fallen to their death.

What is needed is an apparatus that allows a user to remotely inspect, paint, clean, and repair bridge cables. However, in view of the prior art considered as a whole at the time the present invention was made, it was not obvious to those of ordinary skill in the art how the limitations of the art could be overcome.

SUMMARY OF INVENTION

The long-standing but heretofore unfulfilled need for an apparatus that allows a user to remotely inspect, paint, clean, and repair bridge cables is now met by a new, useful, and nonobvious invention. The invention attaches to a bridge's cable. Once attached, the apparatus is remotely directed along the longitudinal extent of the cable. A variety of maintenance devices are fastened to the end of the apparatus and allow the user to remotely and safely inspect, paint, clean, and repair the cable.

The invention generally includes three major components: a frame, a lateral drivetrain, and a radial drivetrain. The frame includes two annulus ends connected by a plurality of support bars. Both annulus ends include two half circle members that are bolted together to form an annulus; alternatively, the half circle members are connected by a pin joint at one end and bolted together at the other end, allowing the frame to hinge open. A plurality of lateral wheel mounts are connected to both annulus ends and secure a plurality of lateral wheels to the frame. Each lateral wheel is adjustable within the lateral wheel mount. The lateral drivetrain includes a motor with a sprocket or gearbox connected to a continuous track. Idlers are disposed within the continuous track and keep the track under tension. A housing encompasses the idlers and acts as a mount for the idlers axles. The radial drivetrain includes a motor with a gear arm or gearbox. The gear arm or gearbox engages a radial track that is disposed around a plurality of radial wheels. The plurality of radial wheels is rotatably secured to a plurality of radial wheel mounts. The plurality of radial wheel mounts is affixed to the frame. A plurality of attachment arms extends from the radial track. Each attachment arm has a maintenance device attached thereto.

In operation, the frame is opened to allow for placement around the cable. Once positioned around the cable, the frame is bolted together. The lateral drivetrain is then adjusted so that the continuous track is firmly against the cable. Likewise, the lateral wheels are adjusted so that they too are positioned firmly against the cable. When the lateral drivetrain is actuated, the device moves longitudinally along the cable. The radial drivetrain motor turns the gear arm or gearbox which rotates the radial track around the cable. The radial motor can be programmed to oscillate the radial track back and forth or a switch can be located in the radial path of the radial track to alternate direction. A variety of bridge maintenance devices may be affixed to the attachment arms, including spray guns, sandblasters, and video recorders. As the apparatus moves longitudinally along the cable, the bridge maintenance devices rotate around the cable allowing the user to remotely inspect or repair the cable. As recited in the claims, the novel cable maintenance apparatus includes a frame including a first annulus disposed in encircling relation to a cable, the first annulus positioned in a plane that is substantially transverse to a longitudinal axis of the cable, the frame including a second annulus disposed in encircling relation to the cable, and the second annulus positioned in a plane that is substantially transverse to the longitudinal axis of the cable. A plurality of circumferentially spaced apart support bars interconnect the first and second annuluses to one another, said support bars being disposed substantially parallel to the longitudinal axis of the cable. A lateral drivetrain has a straight configuration and is adjustably secured to the frame between the first annulus and the second annulus. The lateral drivetrain includes a first motor and a continuous track that frictionally engages the cable along a predetermined longitudinal extent thereof. The first motor is connected in driving relation to the continuous track. A radial drivetrain is secured to a preselected annulus, and a radial track is rotatably mounted to the preselected annulus. The radial track is positioned in a plane that is substantially transverse to a longitudinal axis of the cable. The radial drivetrain includes a second motor in mechanical communication with the radial track and a controller governing operation of the first motor in a first cable-climbing and in a second cable-descending direction. The controller also governs operation of the second motor so that the radial track oscillates in first and second directions relative to the longitudinal axis of the cable. The invention as claimed further includes a first plurality of lateral wheel mounts secured to the first annulus in circumferentially spaced apart relation to one another, a first plurality of lateral wheels rotatably mounted to the first plurality of lateral wheel mounts, a second plurality of lateral wheel mounts secured to the second annulus in circumferentially spaced apart relation to one another, and a second plurality of lateral wheels rotatably mounted to the second plurality of lateral wheel mounts. The first and second plurality of lateral wheels rotatably engage the cable to maintain the frame in concentric relation to the cable as the cable maintenance apparatus climbs or descends the cable. A plurality of attachment arms is affixed to the radial track, each attachment arm of the plurality of attachment arms being substantially parallel to the longitudinal axis of the cable.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

The invention is a cable maintenance apparatus that attaches to a cable and allows a user to remotely inspect, paint, clean, and repair the cable. Cameras, paint guns, sandblasters, and other bridge maintenance devices are attached to the apparatus and rotate about the cable as the apparatus moves along the longitudinal axis of the cable. Thus, a user can remotely inspect or paint every inch of the cable without having to climb or suspend from the cable. This invention is particularly helpful in bridge maintenance because of the dangers associated with heights.

Figure 1:
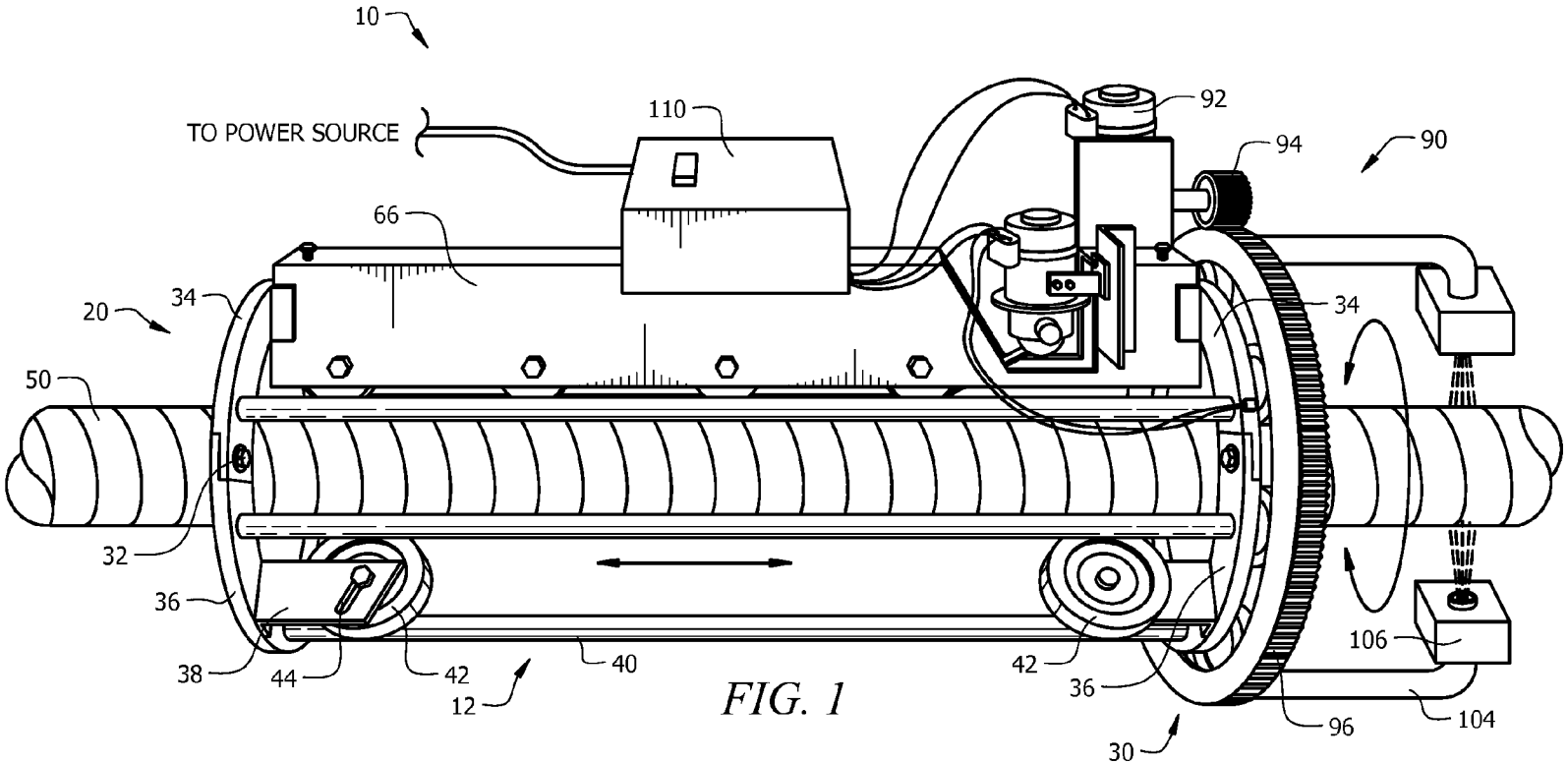
FIG. 1 is an upper perspective view of the apparatus.

As shown in FIG. 1, apparatus 10 includes rigid frame 12. Specifically, annuluses 20 and 30 are connected by support bars 40 to form said frame. Annuluses 20 and 30 include two half circle members 34 and 36, which are connected at their ends by bolts 32. When bolts 32 are removed, frame 12 separates into two halves, allowing said frame to be positioned around cable 50. After being positioned around cable 50, bolts 32 are secured and frame 12 forms one rigid body. In an alternate embodiment, half circle members 34 and 36 are connected by a pin joint and bolt at their opposing ends, respectively, allowing frame 12 to hinge open so that it can be positioned around cable 50.

Lateral wheel mounts 38 are affixed to annuluses 20 and 30. Lateral wheel mounts 38 act as mounts for lateral wheels 42. Slots 44 enables lateral wheels 42 to be slideably adjusted inward and outward so that they are positioned firmly against cable 50. Lateral wheels 42 act as casters and ensure a smooth track as apparatus 10 moves along the lateral axis of cable 50.

Figure 2:
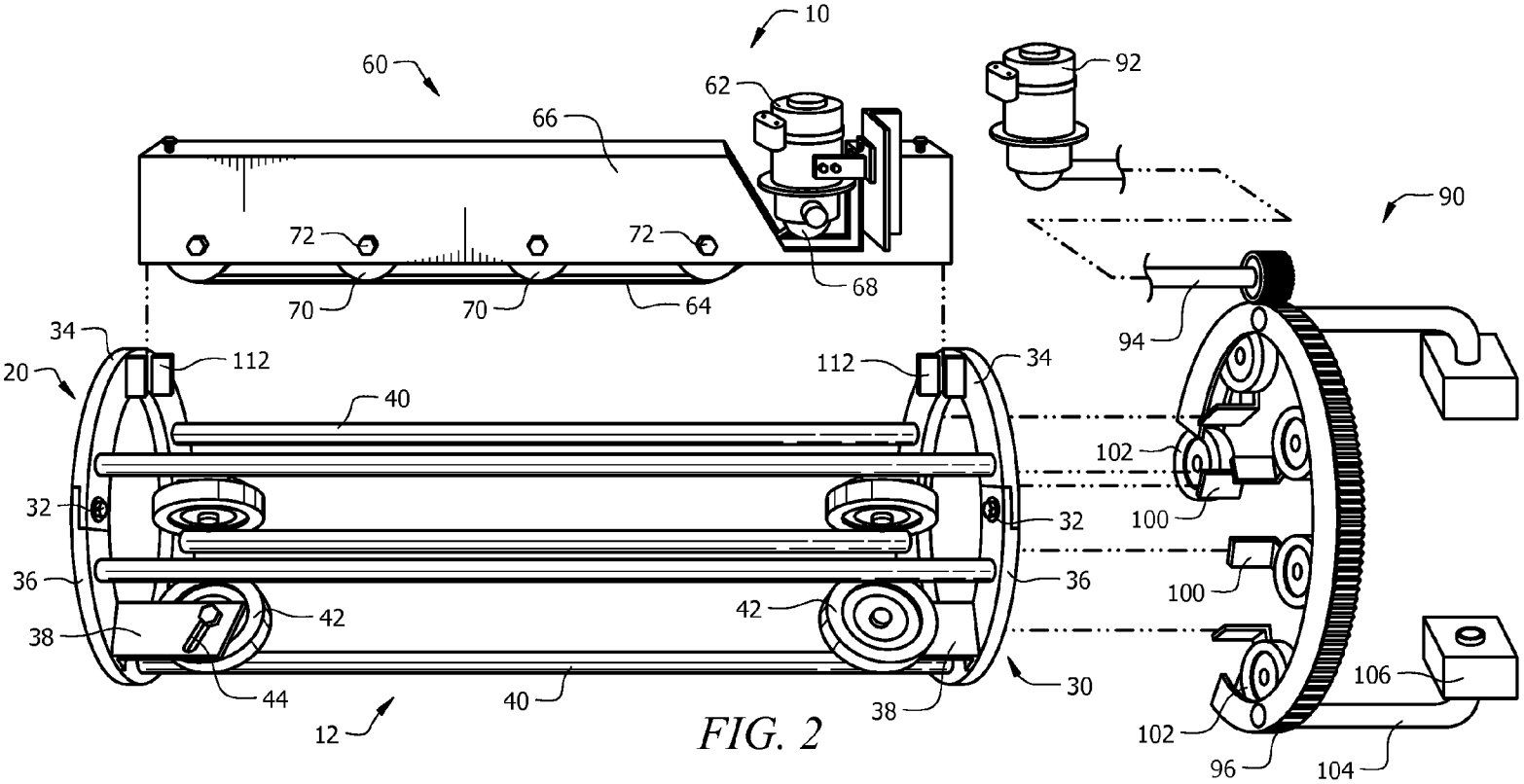
FIG. 2 is an exploded view of the apparatus.

As depicted in FIGS. 1 and 2, radial drivetrain 90 includes radial motor 92, gear arm 94, radial track 96, radial wheel mounts 100, radial wheels 102, attachment arms 104, and maintenance devices 106. Radial motor 92 is attached to frame 12 and turns gear arm 94. Gear arm 94 is mechanically connected to radial track 96 and rotates radial track 96 around cable 50.

In an alternate embodiment, a gearbox mechanically connects radial motor 92 to radial track 96. Radial track 96 rests on and around radial wheels 102. Because it rests on radial wheels 102, radial track 96 freely rotates about the axis of cable 50. Radial wheels 102 are mounted to radial wheel mounts 100. Radial wheel mounts 100 are affixed to annulus 30. Attachment arms 104 extend laterally from radial track 96 and are used to attach maintenance devices 106. Attachment arms 104 may extend parallel to cable 50 or at an angle. Maintenance devices 106 can be any number of attachments; for example, a camera, a spray gun, or a sandblaster. In operation, control box 110 is either programmed to oscillate radial track 96 back and forth or a switch is located in the path of radial track 96, such that when the switch is engaged by radial track 96 it alternates radial track 96's direction. The switch would be attached to annulus 30 and in the rotational path of radial track 96.

In FIGS. 1 and 2, radial track 96 is a partial circle so that cable 50 can be positioned within the diameter of radial track 96.

In an alternate embodiment, radial track 96 is a full circle with a removable member to allow the cable to be positioned within its diameter. After cable 50 is positioned within the diameter of radial track 96, the removable member is reattached creating a complete circle.

Figure 3:
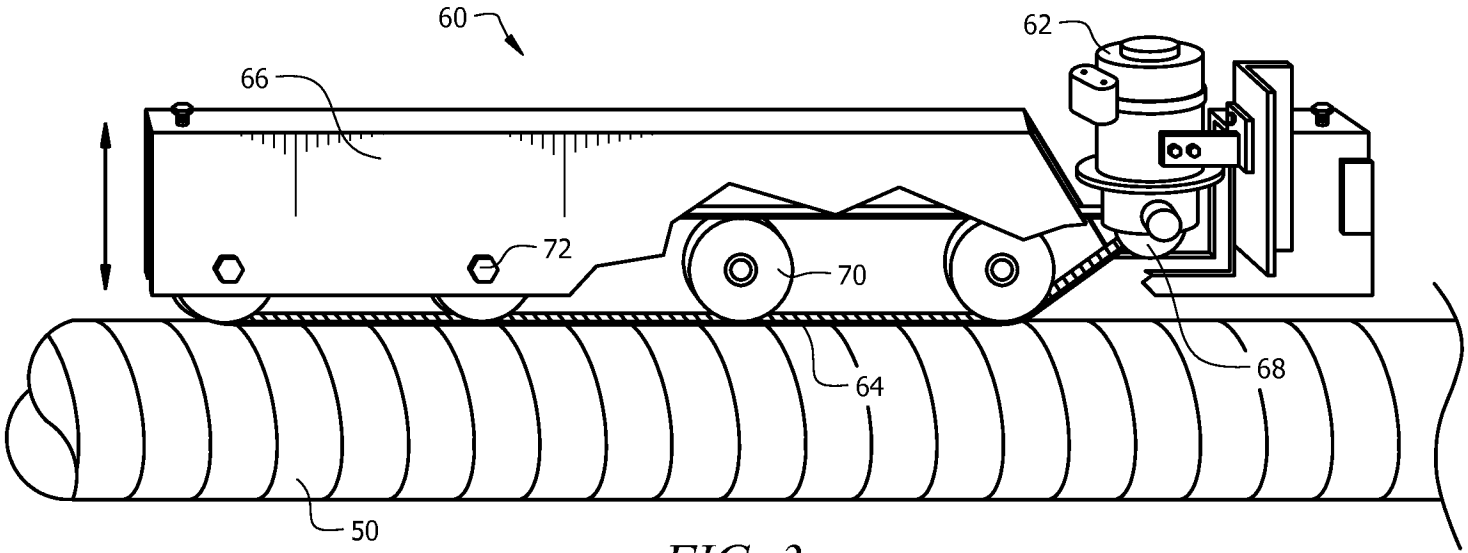
FIG. 3 is a side view of the lateral drivetrain.

As shown in FIGS. 2 and 3, lateral drivetrain 60 includes lateral motor 62, continuous track 64, housing 66, drive sprocket 68, idlers 70, and idler axles 72. The opposing ends of lateral drivetrain 60 are adjustably attached to frame 12 at annuluses 20 and 30, respectively. Annuluses 20 and 30 have slots 112 for slideably receiving lateral drivetrain 60. Once positioned, lateral drivetrain 60 is secured against annuluses 20 and 30 by bolts or screws. Drive sprocket 68 mechanically connects continuous track 64 with lateral motor 62; in an alternate embodiment, a gearbox may be used to mechanically connect lateral motor 62 with continuous track 64. Idlers 70 are positioned within continuous track 64 and maintain continuous track 64 under tension. Idler axles 72 are mounted to housing 66 and allow idlers 70 to rotate freely. In operation, continuous track 64 is positioned against cable 50. Lateral motor 62 is then activated and turns drive sprocket 68 which turns continuous track 64. The forward or backward movement of continuous track 64 moves the apparatus along the extent of cable 50.

Control box 110 is attached to housing 66 in the embodiment of FIG. 1. Control box 110, however, may be disposed anywhere on apparatus 10 where it does not interfere with the lateral and radial movement of the apparatus. Control box 110 houses all of the electronics and may include a CPU.

When using the apparatus, the frame is opened, positioned around the cable, and bolted shut. The lateral drivetrain is then adjusted so that the continuous track firmly abuts the cable and is bolted in place. Next, the lateral wheels are adjusted so that they too firmly abut the cable. The lateral and radial drivetrains are then activated through the control box. Depending on the movement of the continuous tack, the apparatus will move in both directions along the longitudinal axis of the cable. Similarly, depending on the rotation of the radial motor, the radial track and maintenance attachments will rotate around the axis of the cable. The lateral drivetrain and the radial drivetrain are independent of one another. Accordingly, for example, when paint guns are attached, the speed at which the radial drivetrain rotates the sprayers around the cable can be adjusted to correspond to the speed the apparatus is moving along the longitudinal axis of the cable so that a desired coat of paint is applied to the cable.

Figure 4:
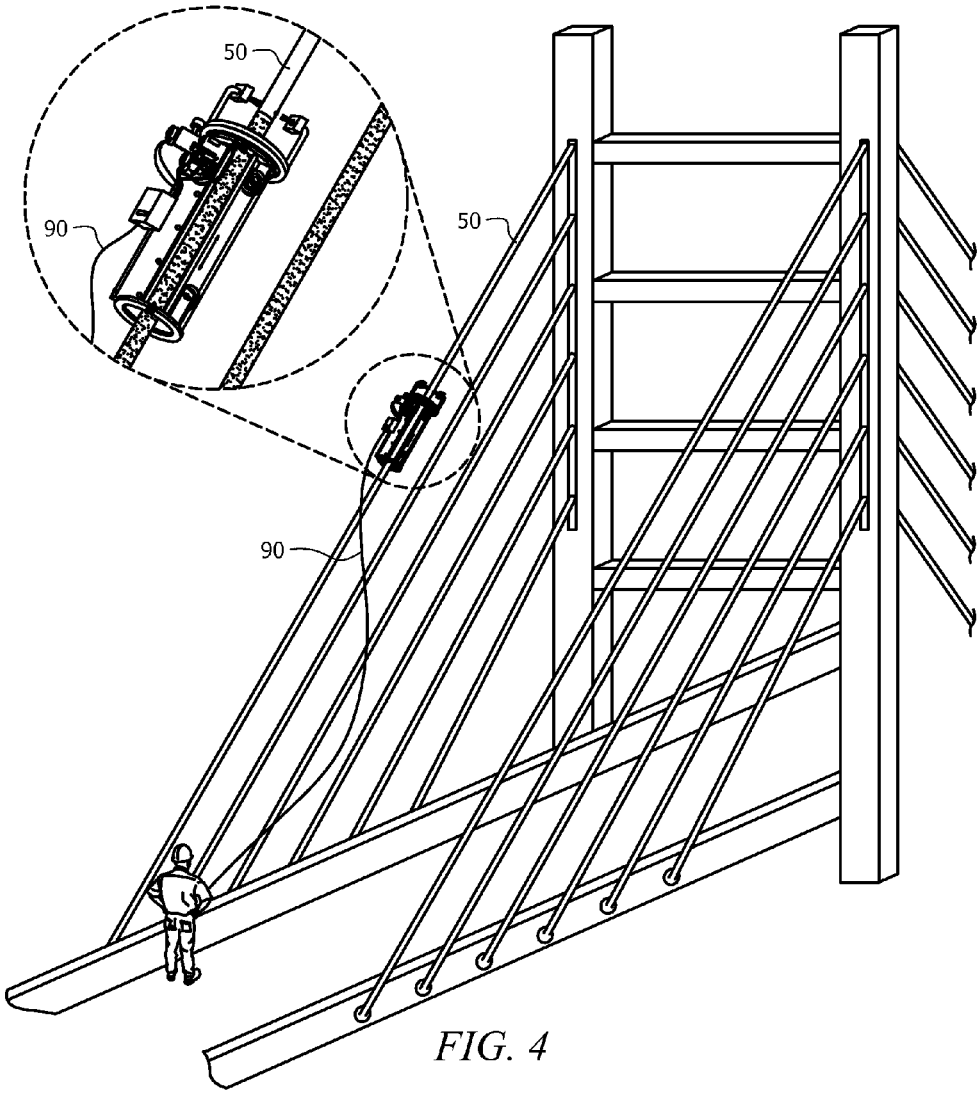
FIG. 4 illustrates the apparatus being used on a cable-stayed bridge.

FIG. 4 shows the apparatus being used on a cable-stayed bridge. As depicted, the apparatus moves along the longitudinal extent of cable 50. The apparatus is controlled remotely from the ground via wire 90 which is in communication with the control box; however, in an alternate embodiment, the apparatus may be adapted to be wirelessly controlled.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

What is claimed is:

1. A cable maintenance apparatus, comprising:

a frame;

said frame including a first annulus disposed in encircling relation to a cable having a predetermined longitudinal extent, said first annulus positioned in a plane that is substantially transverse to a longitudinal axis of said cable;

said frame including a second annulus disposed in encircling relation to said cable, said second annulus positioned in a plane that is substantially transverse to said longitudinal axis of said cable;

a plurality of circumferentially spaced apart support bars that interconnect said first and second annuluses to one another, said support bars being disposed substantially parallel to said longitudinal axis of said cable;

a lateral drivetrain, said lateral drivetrain having a straight configuration and being adjustably secured to said frame between said first annulus and said second annulus;

said lateral drivetrain including a first motor;

said lateral drivetrain including a continuous track that frictionally engages said cable, said first motor connected in driving relation to said continuous track;

a radial drivetrain secured to a preselected annulus;

a radial track rotatably mounted to said preselected annulus, said radial track being positioned in a plane that is substantially transverse to said longitudinal axis of said cable;

said radial drivetrain including a second motor;

said second motor being in mechanical communication with said radial track;

a controller governing operation of said first motor in a first cable-climbing and in a second cable-descending direction; and said controller governing operation of said second motor so that said radial track oscillates in first and second directions relative to said longitudinal axis of said cable as said continuous track moves said cable maintenance apparatus along the longitudinal extent of said cable.

2. A cable maintenance apparatus as in claim 1, further comprising:

a first plurality of lateral wheel mounts secured to said first annulus in circumferentially spaced apart relation to one another;

a first plurality of lateral wheels rotatably mounted to said first plurality of lateral wheel mounts;

a second plurality of lateral wheel mounts secured to said second annulus in circumferentially spaced apart relation to one another;

a second plurality of lateral wheels rotatably mounted to said second plurality of lateral wheel mounts;

said first and second plurality of lateral wheels rotatably engaging said cable to maintain said frame in concentric relation to said cable as said cable maintenance apparatus climbs or descends said cable.

3. A cable maintenance apparatus as in claim 1, further comprising:

said first annulus and said second annulus of said frame each including two half circle members bolted together to form an annulus.

4. A cable maintenance apparatus as in claim 1, further comprising:

said first annulus and said second annulus of said frame each including two half circle members pivotally joined at a first end and bolted together at a second end to form an annulus.

5. A cable maintenance apparatus as in claim 1, further comprising:

said continuous track having a plurality of idlers disposed within said continuous track; and a housing encompassing said idlers.

6. A cable maintenance apparatus as in claim 1, further comprising:

a plurality of attachment arms affixed to said radial track, each attachment arm of said plurality of attachment arms being substantially parallel to said longitudinal axis of said cable.

7. A cable maintenance apparatus as in claim 6, further comprising:

a plurality of maintenance devices selectively attachable, one at a time, to said plurality of attachment arms.

8. A cable maintenance apparatus as in claim 7, further comprising:

said maintenance devices selected from a group of maintenance devices including a sprayer, a camera, and a sandblaster.

* * * * *